United States Patent [19]

Puskarz et al.

[11] 3,986,319

[45] Oct. 19, 1976

[54] WRAP-AROUND PACKER

[75] Inventors: Stanley J. Puskarz, Bristol; Horst G. Lattke, Middletown, both of Conn.

[73] Assignee: Emhart Industries, Inc., Hartford, Conn.

[22] Filed: July 3, 1974

[21] Appl. No.: 485,713

Related U.S. Application Data

[62] Division of Ser. No. 333,453, Feb. 20, 1973, Pat. No. 3,866,391.

[52] U.S. Cl. ..... 53/26; 53/32; 53/207; 53/228

[51] Int. Cl.[2] ..... B65B 11/16

[58] Field of Search ..... 53/207, 26, 29, 32, 53/62, 159, 166, 228, 233

[56] References Cited

UNITED STATES PATENTS

| | | | |
|---|---|---|---|
| 1,793,595 | 2/1931 | Douglass | 53/159 X |
| 2,535,880 | 12/1950 | Tomkins | 53/26 |
| 2,933,207 | 4/1960 | Edmunds | 53/159 X |
| 2,997,830 | 8/1961 | Nelson | 53/62 |
| 3,082,584 | 3/1963 | Schmid | 53/62 |
| 3,482,372 | 12/1969 | Hottendorf | 53/32 |
| 3,531,907 | 10/1970 | Smith | 53/29 |
| 3,555,776 | 1/1971 | Nigrelli | 53/207 X |
| 3,570,209 | 3/1971 | Salwasser | 53/159 X |
| 3,579,956 | 5/1971 | Hoffmann | 53/159 |
| 3,580,640 | 9/1970 | Hoffmann | 53/207 X |
| 3,584,434 | 6/1971 | Ellis | 53/159 |
| 3,727,370 | 4/1973 | Lassig | 53/159 |
| 3,739,545 | 6/1973 | Lattke | 53/29 |
| 3,834,114 | 9/1974 | Johnson | 53/32 |

*Primary Examiner*—Travis S. McGehee
*Assistant Examiner*—J. Sipos
*Attorney, Agent, or Firm*—McCormick, Paulding & Huber

[57] ABSTRACT

Arrays of articles are stacked one on top of another in a U-shaped shroud structure which includes vacuum means to retain the upper array while the lower array of articles is positioned therebeneath. A carton blank is simultaneously fed from a stack to a position over the pocket of a intermittently operated conveyor. A vertically reciprocable mandrel forms the flat blank into a U-shape in one of these pockets. Both the mandrel and shroud are mounted on a shifting carriage so that as the mandrel is moved to an inactive position, the shroud shifts the arrays of articles onto the bottom panel of the U-shaped carton blank. Flap folding devices then fold certain of the end flaps of the carton and the shroud is then raised clear of the partially formed box so that the top panel can be folded. The manufacturer's flap and certain other end flaps are then folded up and the box conveyed by the pocket chain conveyor to a horizontal compression unit. Another version of this packer is adapted to handle single arrays in nested configuration for achieving a very tight pack.

4 Claims, 26 Drawing Figures

WRAP-AROUND PACKER

This is a division, of application Ser. No. 333,453 filed Feb. 20, 1973 now U.S. Pat. No. 3,866,391.

BACKGROUND OF INVENTION

This invention relates generally to forming a packing case around a slug of articles, and deals more particularly with a machine for handling either one, or more than one, slug of articles to be included in a single case.

Machines of this general type are shown in the prior art, and by way of example, the disclosure in U.S. Pat. No. 2,924,051 shows a mechanism for forming a double tier load for a side open partially formed carton or case. However, the load is formed in this prior art machine by raising one slug upwardly onto a support and then raising the next succeeding slug of articles upwardly to support the first. The present invention provides an improved mechanism for positively retaining control of the first tier or slug while the load is formed, and also while the double tier load is transferred into an upwardly open case.

Still by way of example, U.S. Pat. No. 2,997,830 shows a machine for forming a multi-tier load of regularly shaped articles wherein the upper tiers are not positively supported but wherein the load is transferred into a generally U-shaped carton blank. The case, with its load, is moved through successive folding stations by a pocket chain conveyor which has sets of removable and replaceable blocks to allow the machine to accommodate loads of various size and cartons of corresponding configuration. The present invention not only provides an improved load handling mechanism with improved control of the load, but also allows the size of the load and of the cartons to be conveniently changed by the machine operator without any necessity for removing and replacing pocket defining blocks.

SUMMARY OF INVENTION

In accordance with one presently preferred embodiment of the present invention, flat carton blanks are fed to a blank infeed station below a vertically reciprocable mandrel which folds the carton into a U-shape. The articles are formed on a lift table in an orderly array and then raised up to be supported by a vacuum device provided for this purpose in an inverted U-shaped shroud. The shroud and the mandrel are both mounted in a transfer carriage which shifts the load after a double tier of articles has been so formed, one in the shroud, the other on the lift table. A depending leg of the U-shaped shroud will slide the lower tier off the lift table and into the U-shaped carton and at the same time, the mandrel which so formed the carton, will be retracted and shifted to an inactive position by the carriage. The U-shaped carton and its load are formed in a pocket defined by two side-by-side conveyors or chains which operate together to move carton and load to a succeeding station for further folding and gluing up of the flaps. A novel horizontal compression unit permits folding of the trailing manufacturer's flap while the case is discharged from the pocket chain conveyor.

In accordance with another form of the present invention, a single slug of articles is formed on a deadplate and the U-shaped shroud structure has depending legs which include camming devices for shifting alternate rows of articles in opposite directions relative to one another and by approximately one half of an article diameter. During transfer onto the bottom panel of the article blank, these rows are nested by side guides to fit between the upright side panels of U-shaped blank. The bottom panel of the blank has a length and width to accommodate the nested array, and the various end flaps are folded up and glued as in the above-described embodiment.

DETAILED DESCRIPTION OF FIRST PREFERRED EMBODIMENT

Figure 1:
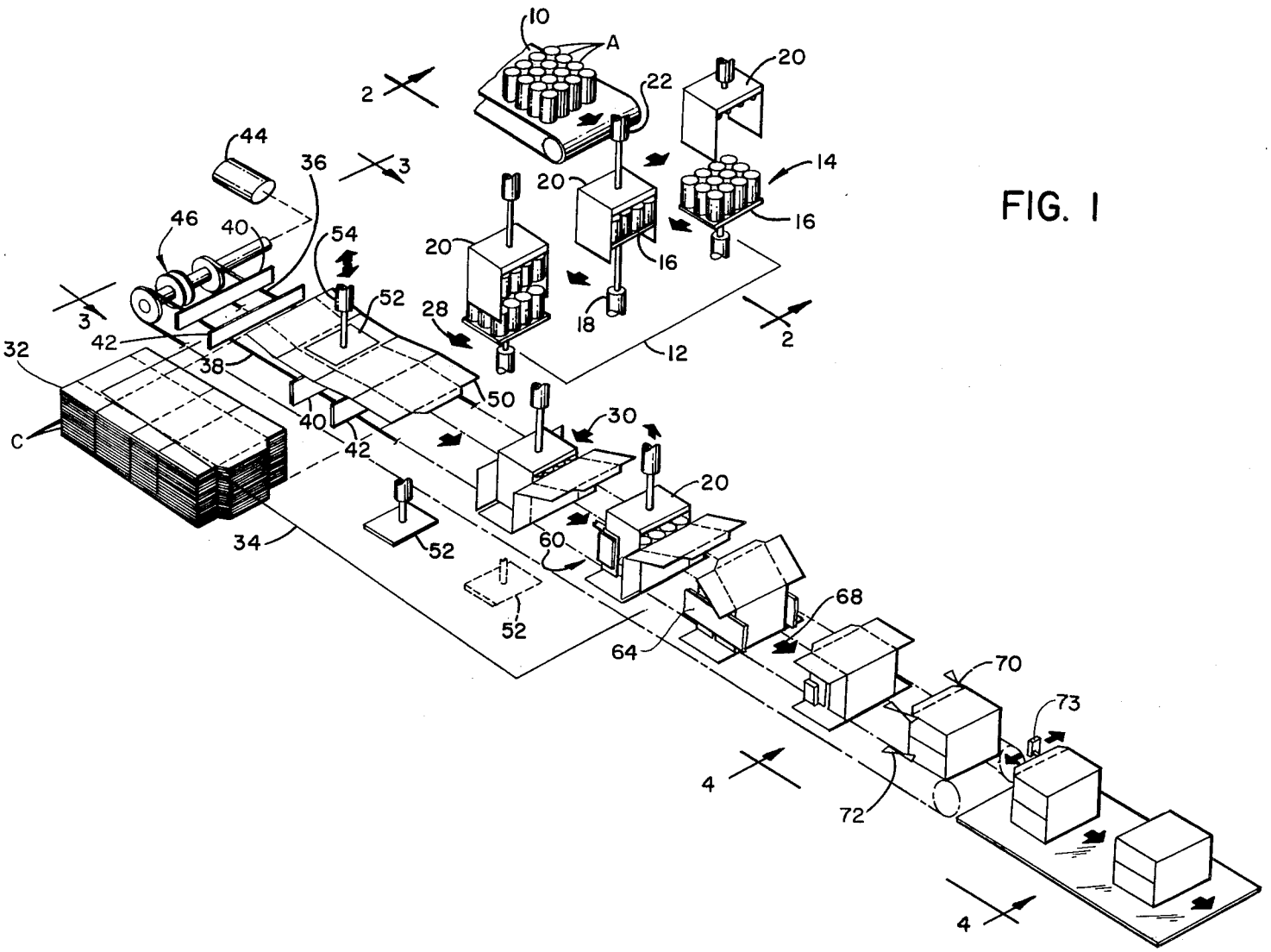
FIG. 1 is a schematic view of the carton and its contents as they are handled by some of the more essential components of a machine embodying the present invention.

Turning now to the drawings in greater detail and referring more particularly to FIG. 1, articles A, A are fed generally toward an article infeed station, to be described, in orderly rows and columns on a conventional article infeed conveyor 10. Suitable lane dividers and other structure have been omitted from this view for clarity and as will be apparent from the description to follow, the various views of the arrays of articles and the carton blanks, as well as the structure shown schematically in FIG. 1, have been exploded to better reveal the manner of operation of a machine embodying the present invention.

Means defining an article infeed station is represented schematically by the three views of the same apparatus depicted generally at 12 in FIG. 1. The articles are segregated by conventional grouping means (not shown) into arrays or slugs as indicated generally at 14. A vertically reciprocable lift table structure, indicated generally at 16, is adapted to receive the first slug of articles 14 from the infeed conveyor 10 in the first step of forming the load for a wrap-around carton C. After so receiving a first array or slug 14, the lift table 16 is raised upwardly so that the first slug of articles is received in an inverted U-shaped shroud structure 20.

The shroud structure 20 is also reciprocably mounted in the machine as indicated generally by the actuator 22. This actuator 22 will cause the shroud 20 to descend as the lift table 16 raises the first slug of articles 14 into the position shown in FIGS. 2 and 2A, 3 and 3A. The views of FIGS. 2A and 3A correspond to the second or mid-view of the article infeed station 12 in FIG. 1.

Figure 2:
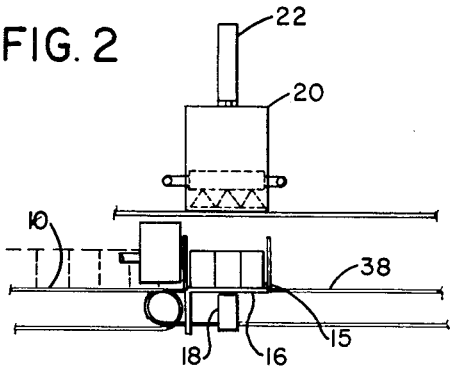
FIG. 2 is a side elevational view taken generally on the line 2—2 of FIG. 1.
Figure 3:
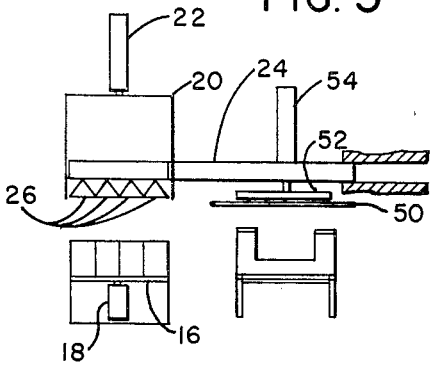
FIG. 3 is an end elevational view taken generally on the line 3—3 of FIG. 1.

FIGS. 2 and 3 show the inverted U-shaped shroud 20 in somewhat greater detail, and referring more particularly to FIG. 3, it will be apparent that this shroud structure 20 is mounted for vertical movement in a carriage 24. The carriage is itself movably mounted for limited horizontal shifting movement between the position shown in FIG. 3 and that shown in FIG. 3C. A series of vacuum cups 26 is provided in the carriage 24 and more particularly in association with the vertically movable shroud 20 and serves to hold the articles in the first slug referred to above in the U-shaped shroud during the horizontal shifting movement of the carriage.

Turning once again to the schematic view of FIG. 1, the carriage 24 has been omitted from this view, but as suggested in the third and last view of the shroud 20 at the article infeed station 12, a second slug or array of articles is received on the elevator 16 when the elevator 16 has been lowered for receiving said second array of articles, and both the first and second slugs or arrays of articles are transferred in the direction of the arrow 28 in FIG. 1. This horizontal shifting movement of the carriage 24 results in controlled movement of both the upper and lower slugs of articles from the position shown in FIG. 3B to that shown in FIG. 3C. It should be noted that side guides (not shown) are preferably provided alongside the short path of movement of the double tier load as it is moved off the lift table and across a short deadplate (not shown in FIG. 1). Thus, control of the load is maintained by the U-shaped shroud structure which transfers the load from the article infeed station 12 to the carton forming station 34 to be described.

It is an important feature of the present invention that simultaneously with formation of the double tier load, a carton blank C is simultaneously folded into a generally U-shaped configuration at a box forming station 34 so that the double tier load can be received therein as indicated generally by the arrow 30 in FIG. 1. As illustrated in FIG. 1, a machine embodying the present invention includes a suitable magazine structure for storing a stack 32 of flat carton blanks. Means (not shown) is provided for withdrawing the lowermost blank in the stack and transferring it to the box forming station 34, indicated in exploded configuration. As with the description of the article infeed station 12 referred to above, the box forming station 34 also shows an initially flat box blank C as a first step in forming the box at said station, with sequential views showing the blank as it is being folded, and corresponding generally to the views depicted in FIGS. 2 and 2A, 3 and 3A. As depicted in the mid-view at this box forming station 34, the U-shaped shroud structure 20 will move the double tier load between the upstanding side panels of the box blank thereby providing a very high degree of control over the articles as a result of the depending legs of the U-shaped shroud, and the upstanding side panels of the U-shaped blank. In addition, the load can be seen to follow a substantially horizontal path through the machine of FIG. 1, and this design concept carries through the entire machine, even to the horizontal compression section to be described. Only the requirement for lifting every other slug at the article infeed station sees any departure from this design concept.

A pair of side-by-side pocket defining chain conveyors 36 and 38 each carry one side member of a pocket defining structure, indicated generally at 40 and 42 respectively, and several such pocket defining members are arranged in spaced relationship in each of said chains. A conventional intermittent drive mechanism, indicated generally at 44 is provided to advance these pockets as indicated in FIG. 1. Thus, each such pocket is sequentially presented to the box forming station 34 and it is an important feature of the present invention that two such chain conveyors are provided, each one of which chain conveyors carries one side of each of the individual pocket defining structure. Both chains are driven from a common drive mechanism 44, but each chain conveyor is independently adjustable one with respect to the other through a clutching device 46 in order to permit setting up the machine to form boxes of various size.

As mentioned above, the lowermost blank in the stack 32 is fed to the box forming station immediately above a stationary pocket on the intermittently driven pocket chain conveyor, as best shown in FIG. 3 of the drawings, and more particularly as indicated generally at reference numeral 50. The initially flat box blank 50 is supported by guides (not shown) and a box forming mandrel is slidably mounted in the carriage 24 for vertical movement in response to actuation of a fluid actuator 54. Thus, when the blank 50 has been positioned as shown in FIG. 3, the mandrel 52 is lowered to the position shown in FIG. 3 causing the box blank to assume a generally U-shaped configuration as suggested in FIG. 3A. Since the mandrel 52 is provided on the end of an actuator 54 which is mounted in the carriage 24, it will be apparent that following retraction of the mandrel, as shown in FIG. 3B, it will be shifted to an inactive position as the double tier load is shifted into the generally U-shaped carton blank as shown generally at 30 in FIG. 1 and as shown in detail in FIGS. 2C and 3C.

Figure 2A:
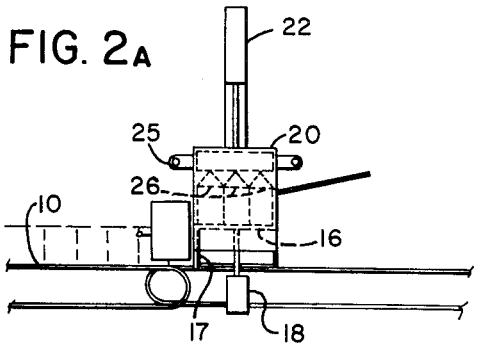
FIGS. 2A – 2F inclusively are views similar to FIG. 2 but showing this view at successively later instants of time during a machine cycle.

Referring now to FIG. 2A of the drawings, the lift table 16 is shown raising the first slug of articles at the article infeed station upwardly into the shroud 20, which shroud has been lowered slightly so that the vacuum cups 26, 26 will engage the upper sides of the articles to hold them in place. The lift table 16 is then lowered for receiving the next slug of articles. As shown in FIG. 2A, a depending skirt 17 is provided on the lift table 16 to prevent articles from prematurely moving off the infeed conveyor 10. A lip 15 is also provided on the lift table 16 for controlling the position of both the first and second slugs of articles being handled by said lift table. Still with reference to FIG. 2A, vacuum manifold 25 is provided in the carriage 24 to selectively connect the vacuum cups 26, 26 to a source of pressure that is less than atmospheric in order to securely hold the first slug of articles during the transfer of the double tier load from the FIG. 3B position to the FIG. 3C position.

Figure 3A:
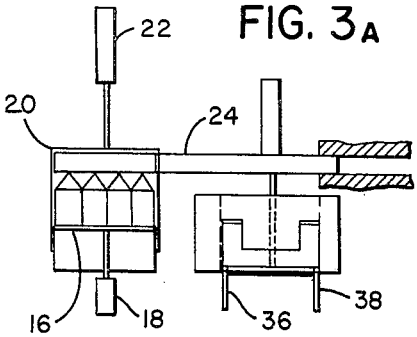
FIGS. 3A – 3F inclusively are views similar to FIG. 3 but showing this view at successively later instants of time during a machine cycle.
Figure 3B:
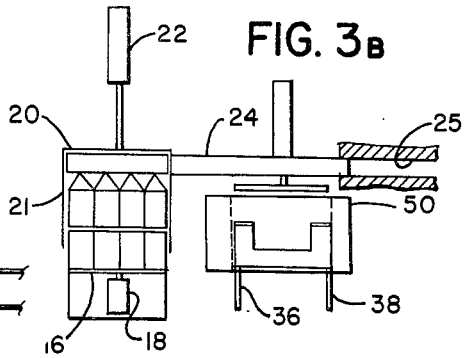
Figure 3C:
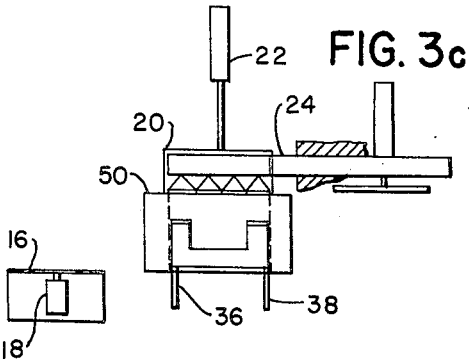

It is an important feature of the present invention that the second, or lower slug of articles in the double tier load of FIG. 3B, is positively shifted or transferred as a result of the depending leg 21 at the rearward side of the inverted U-shaped shroud 20. The forward leg of the U-shaped shroud 20 serves to positively control the load as it decelerates after having been transferred to the box forming station 34. In this manner, the lower or second slug of articles can be controlled as it is shifted horizontally off the lift table 16, across a deadplate (not shown) and onto the bottom panel of the generally U-shaped box blank 50 as shown in FIGS. 3B and 3C. Still with reference to FIGS. 3B and 3C, the carriage 24 can be seen to be slidably received for this horizontal shifting movement in a guideway 25 defined in the fixed frame of the machine.

Figure 2B:
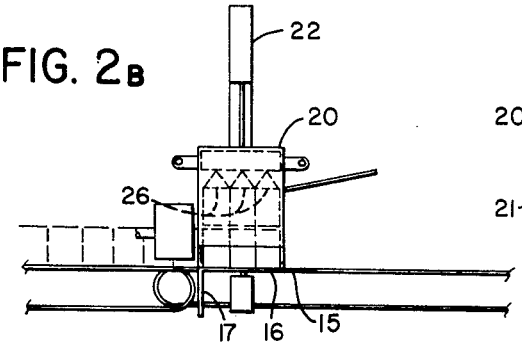
Figure 2C:
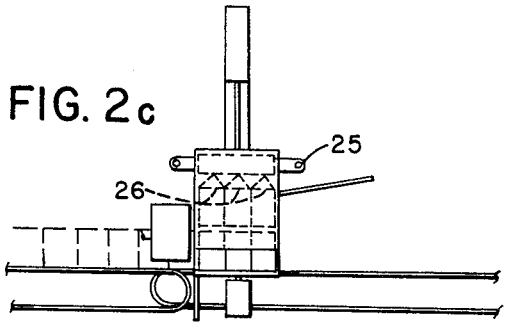

The carton blank 50 comprises a conventional wrap-around carton blank which includes a bottom panel together with associated side panels and a top panel connected to one edge of one of the side panels. The top panel carries a manufacturer's flap, which is preferably oriented at the forward end of the blank at the box forming station 34. The top panel is preferably folded back upon itself at least initially in a direction opposite that which it will ultimately assume, as indicated generally at the box forming station 34, and as suggested in FIGS. 2A and 2B. End flaps are associated with the bottom panel, the side panels and the top panel as is conventional with a typical wrap-around carton blank. The mechanism for folding up these flaps will now be described in detail.

Figure 2D:
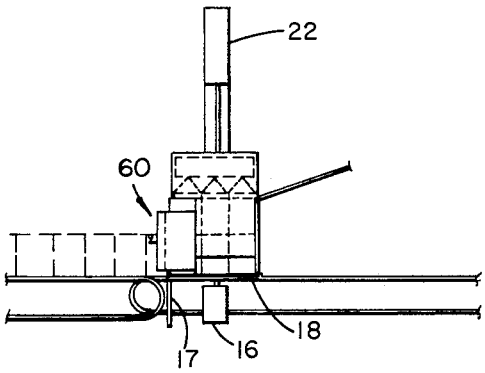
Figure 3D:
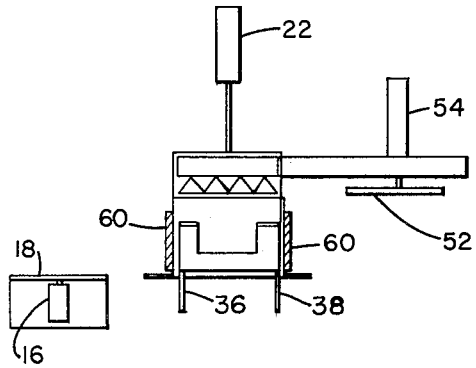
Figure 2E:
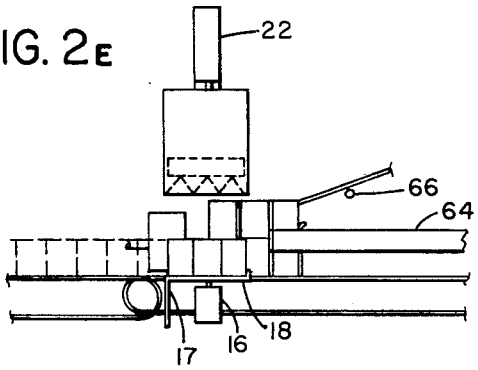
Figure 3E:
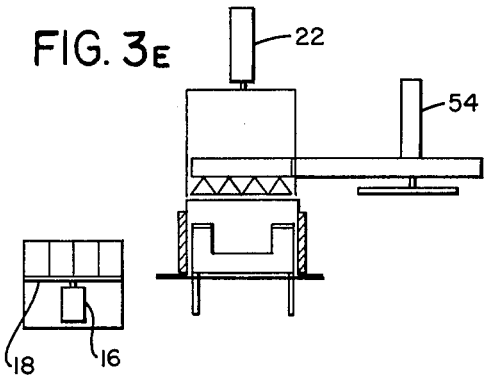

The vertically reciprocable mandrel 52 serves to fold the carton blank into an initial U-shaped configuration as the blank 50 is urged downwardly into the pocket defined by the pocket chain conveyor system described above. This initially U-shaped configuration of the box blank is achieved during the cycle of operation of the machine as depicted in FIGS. 2A and 3A. Referring now to a comparison of the views of the second and third sheets of drawings, FIGS. 2D and 3D show a trailing end flap closing device 60 after having folded the trailing end flaps from the FIGS. 2C and 3C positions. The flap folder 60 is of conventional construction, and serves to fold the trailing end flap through 90°, where these flaps are held by the guide rail 64 of FIG. 2E. This rail 64 serves to fold the leading end flaps as the box is moved downstream from the box forming station as shown in FIGS. 2E and 3E.

A top flap folding device 66 is arranged to fold the top panel back in its proper direction as suggested generally in 2E and 2F. This folding of the top flap will be accomplished as the pocket chain conveyor system moves the partially folded carton blank together with its contents out of the box forming station and downstream as indicated generally by the arrow 68 in FIG. 1. Prior to this motion of the pocket chain conveyor system, it will be apparent that the shroud 20 must be retracted from the position shown in FIG. 2D to that of FIG. 2E. It is also noted that the vacuum cups 26, 26 are deactivated to release the upper slug of articles prior to raising of the shroud 20. The end flap folding device 60 associated with the trailing end flaps of the side panel of the carton blank are also activated prior to movement of the pocket chain conveyor system.

As the partially folded box and its contents are conveyed downstream by the pocket chain conveyor system, fixed upper and lower sets of plows 70 and 72 respectively, fold the end flaps associated with the top and bottom panels inwardly against the previously folded end flaps associated with the side panels. An adhesive applying device (not shown) is preferably activated to apply an adhesive to one or more of these end flaps between the folding of those end flaps associated with the side panels and those associated with the top and bottom panels of the box blank.

Figure 4:
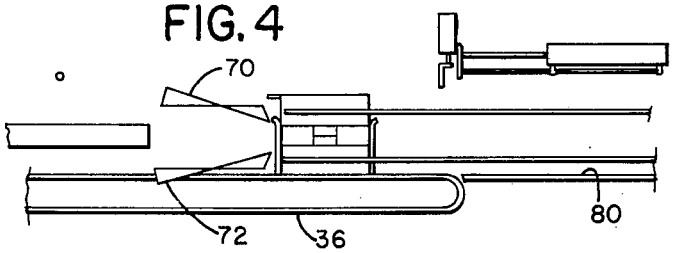
FIG. 4 is a side elevational view taken generally on the line 4—4 of FIG. 1.
Figure 5B:
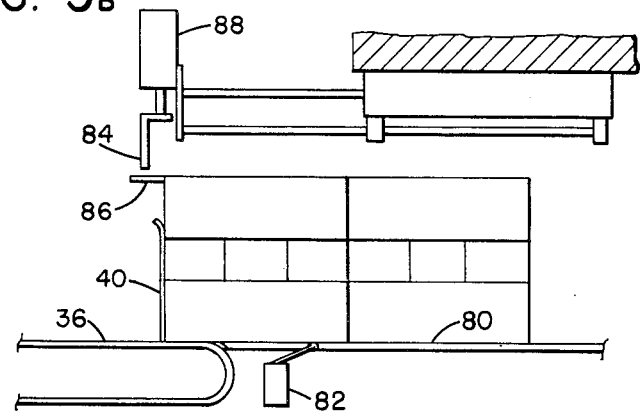
FIGS. 5A – 5C inclusively are views similar to FIG. 5 but showing this segment of the machine at successively later instants of time during a machine cycle.
Figure 5C:
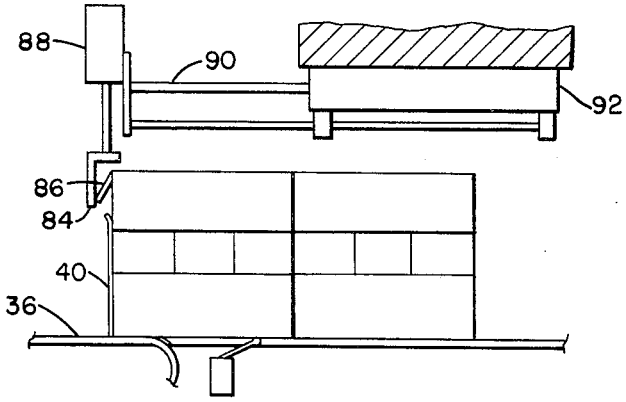
Figure 5:
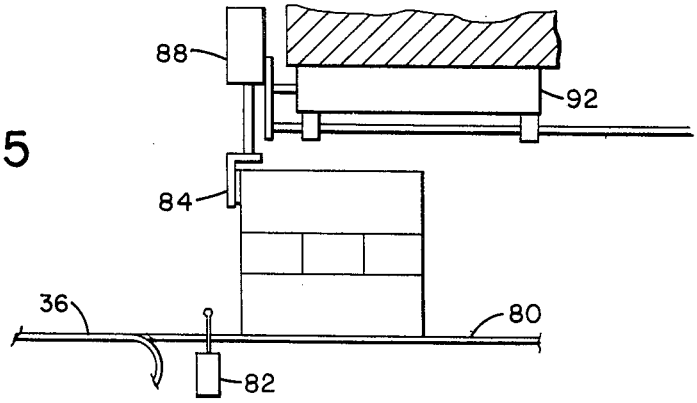
FIG. 5 is a more detailed view of a downstream segment of the view shown in FIG. 4.
Figure 5A:
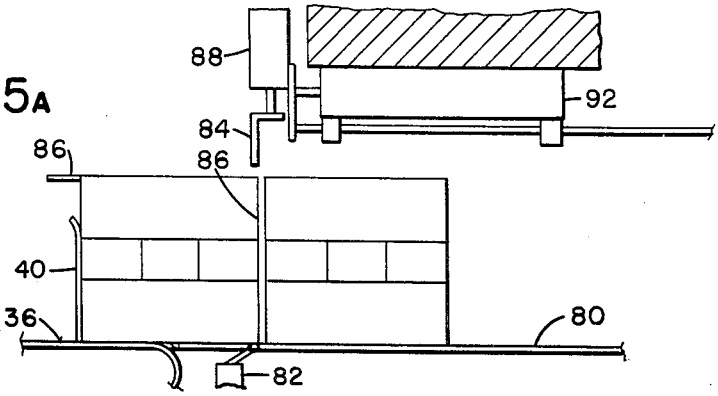

As shown in FIG. 4, the pocket chain conveyor system serves to advance the box, together with its contents, toward a deadplate 80 which comprises part of the manufacturer's flap folding apparatus of the present machine. Referring now more particularly to FIG. 5 of the drawings, a limit switch 82 will be actuated in response to transfer of a box onto the deadplate 80 and this limit switch 82 initiates a series of events for folding the manufacturer's flap as follows. Immediately upon closing of the switch 82, a vertically reciprocable plow 84 is raised as shown in FIG. 5A. The vertically reciprocable plow 84 is itself mounted on a horizontally reciprocable structure 90 including an actuator 88. Upon completion of the upward stroke of the plow 84, actuator 92 extends as shown in FIG. 5B. The manufacturer's flap is provided with a fast setting adhesive by a device 73 in FIG. 1, as is conventional practice. When a succeeding box is fed onto the deadplate 80 as shown in FIG. 5B, and when the actuator 92 has fully extended, the plow 84 descends folding the flap 86 as shown in FIG. 5C. The manufacturer's flap of the preceeding case will be held in position by this next case to set the adhesive in what amounts to a horizontal compression unit. Side belts may be provided in this horizontal compression unit as is conventional practice to restrict the freedom of horizontal movement of the packing cases being compressed therein.

DETAILED DESCRIPTION OF SECOND PREFERRED EMBODIMENT

Turning now to a detailed description of the alternative or second preferred embodiment depicted in FIGS. 6 – 11 inclusively, it should be noted that the preceding embodiment is quite similar to the alternative one in that the load of articles is handled in a controlled manner and restricted to motion in a horizontal plane only. Basically, the alternative embodiment provides for handling a single slug of articles rather than the double tier load shown in FIGS. 1 – 5 inclusively, and also utilizes an improved method and means for compacting the load prior to transfer to the U-shaped blank to permit a tighter pack in the resulting box. From the description to follow, it will be apparent that the apparatus of FIG. 1 could be adapted to handle single slugs of articles with or without the load compacting feature to be described.

In view of the basic similarity between certain components of the FIG. 1 machine and that to be described, identical parts will be referred to by identical reference numerals, and similar parts by the same numerals followed by the subscript *a*. A charge or slug of articles A, A is formed on a deadplate **16*a* which need not comprise an elevator or lift table such as that described above, but which deadplate 16*a* receives columns of articles from the infeed conveyor 10 in much the same manner as described above with reference to the article infeed station of FIG. 1**.

Figure 6:
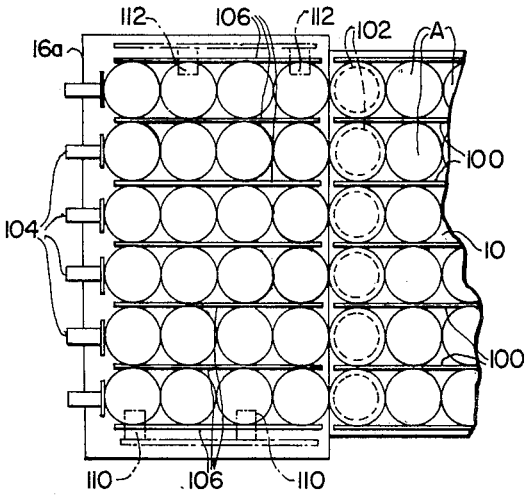
FIG. 6 is a plan view of the slug forming station in an alternative version of a machine similar in many respects to that shown and described in FIGS. 1–5 but being especially adapted for packing single slugs of articles in a very tightly compacted configuration.
Figure 7:
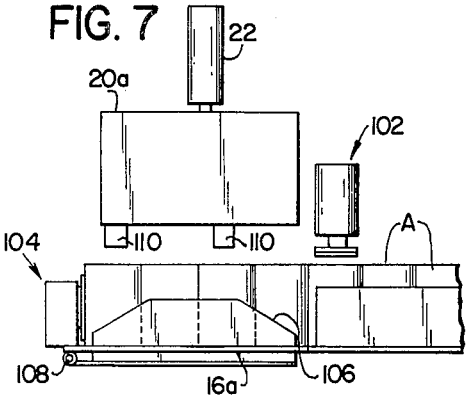
FIG. 7 is a side elevational view of the FIG. 6 machine, being similar, but opposite in hand with respect to FIG. 2 above.

Lane defining means 100 is preferably provided over the infeed conveyor 10 as is conventional practice, and line brakes 102 are also provided to interrupt the flow of articles once a slug or charge has been formed as shown in FIGS. 6 and 7. Conventional detection devices 104, 104 at the downstream end of the deadplate sense the formed slug and trigger the descent of the U-shaped shroud structure 70*a*.

Figure 9:
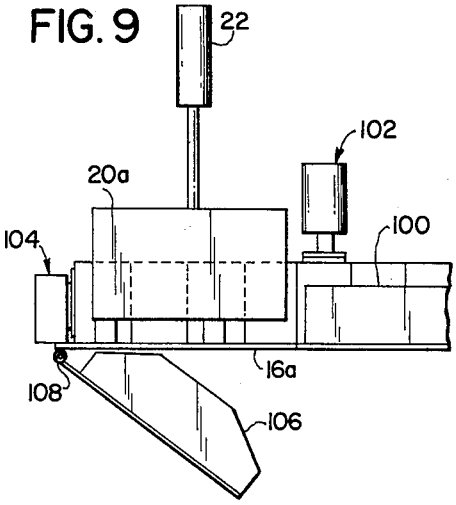
FIG. 9 is a side elevational view similar to FIG. 7 but taken at the same time as FIG. 8 during a given machine cycle.

In order to control the flow of articles over the deadplate 16*a* during formation of the slug, retractable lane defining plates 106, 106 are initially raised, as shown in FIG. 7, but are retracted once the slug is formed to the FIG. 6 configuration. FIG. 9 shows the retracted position of these plates 106, 106 and it will be apparent from this view that all of these plates are carried on a common rock shaft 108 so as to be conveniently retracted from the FIG. 7 to the FIG. 9 position.

Figure 8:
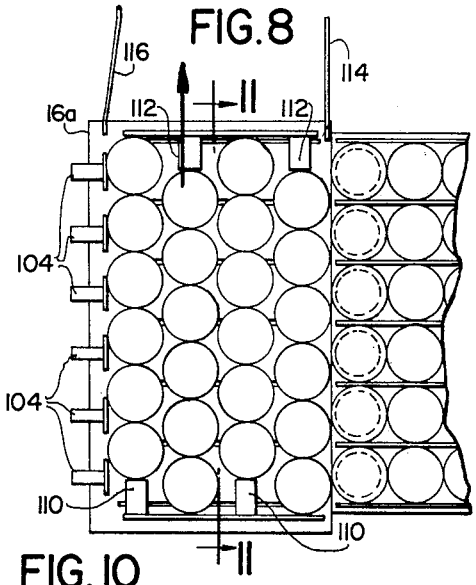
FIG. 8 is a plan view similar to FIG. 6, but at a slightly later instant of time during a machine cycle.
Figure 11:
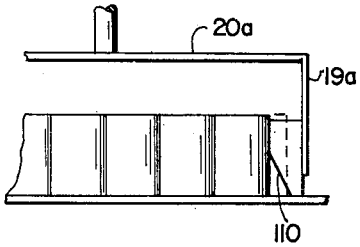
FIG. 11 is a sectional view taken on line 11—11 of FIG. 8.

As these plates 106, 106 reach their retracted positions, the inverted U-shaped structure 20*a* descends just as described above with reference to the first embodiment. However, and as best shown in FIG. 8, the leading and the trailing legs, 19*a* and 21*a* respectively, of this U-shaped structure 20*a*, unlike those of the shroud 20 in FIG. 1, have inwardly facing camming devices 110, 110 and 112, 112 respectively, which shift every other row of articles as depicted in FIG. 8. The article engaging surface of these devices 110 and 112 is preferably inclined as shown in FIG. 11 to better accomplish this shifting motion of the slug rows.

Figure 10:
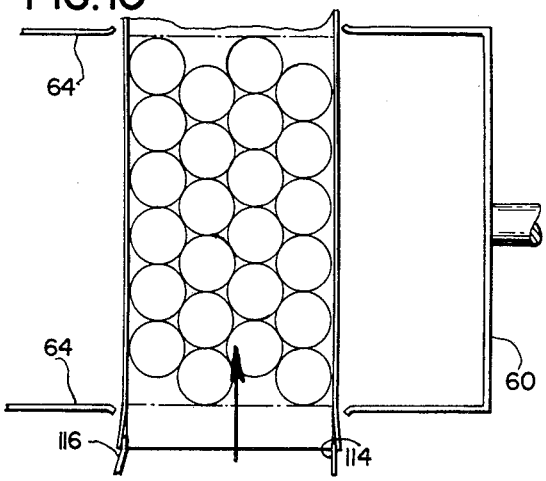
FIG. 10 is a plan view of the carton forming station of the FIG. 6 machine.

Still with reference to FIG. 8 and as a result of this shifting of rows within the slug of articles, at least some of the adjacent articles in adjacent rows will not be in contact with another. The present invention takes advantage of this space between rows to compact the slug as it is transferred by the U-shaped structure from the deadplate 16*a* onto the bottom panel of the carton blank (FIG. 10). As the slug is so transferred, side guides 114 and 116 (FIG. 8) squeeze these rows into a more compacted or nested relationship to the extent permitted by the inside dimension of the devices 110 and 112 on the U-shaped structure 20*a*. In fact, except for the slight spacing achieved by shifting adjacent rows of articles in opposite directions, the slug of articles to be packed is well controlled in the apparatus shown. Initially, the retractable plates keep the articles in orderly columns and rows, and as the U-shaped shroud descends, the lane detectors 104, together with the row of articles held back by the line brakes 102, restrain the articles in one direction while the devices 110 and 112 do the restraining in the other direction.

Figure 2F:
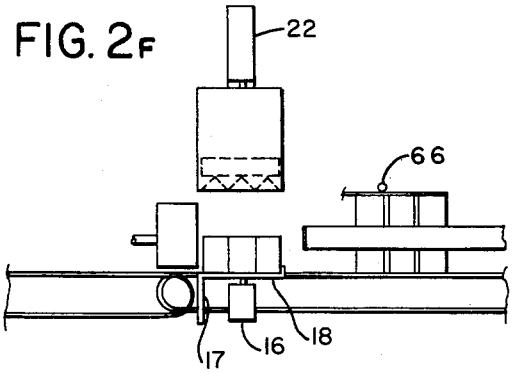
Figure 3F:
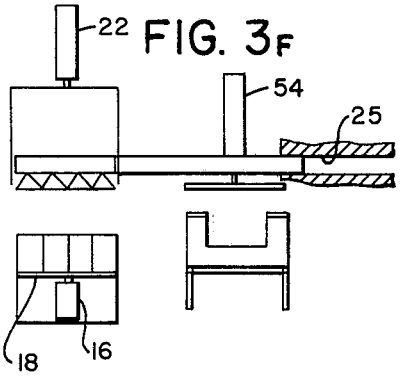

Referring now to FIG. 10 , the nested array of articles provides a compact slug having a longitudinal dimension which is slightly longer than would be the case for a conventional un-nested slug, but having a width which is slightly less than that of the slug with aligned rows and columns. The blank is sized to account for this slug configuration and the end flap folding device 60 will operate in the manner described above to fold the trailing end flaps prior to movement of the carton downsteam. After the device 60 has so folded the trailing end flaps the pocket chain conveyor moves the carton between fixed guides 64, 64 aligned with the legs of the device 60 to fold the leading end flaps as described above. The top panel is folded by a suitable device such as described above at 66 with reference to FIGS. 2E and 2F. Finally, the end flaps associated with the bottom and top panels are glued and folded by fixed plows such as shown at 72 in FIG. 1, and the package fed into a compression unit such as that described hereinabove.

The partially folded box and its load are then moved downstream by the same pocket chain conveyor system described hereinabove, and the various end flaps glued and folded in a similar manner. A horizontal compression unit similar to that described above is well suited to use with this second preferred embodiment.

We claim:

1. A method for forming a box around stacked arrays of generally cylindrical articles, and comprising the steps of, a. providing a box blank at a box forming station, said blank having a bottom panel, a pair of side panels and end flaps carried by each of said side panels, b. supporting the initially flat blank at spaced locations associated with its side panels, and pushing the bottom panel downwardly with respect to such supporting points whereby to fold the side panels upwardly to form a U-shaped box blank at said box forming station, c. raising a first array of articles on an elevator into a transfer shroud at an article infeed station and holding the first array in the shroud while a second array is received on the elevator, d. transferring both arrays horizontally out of the article infeed station and onto said bottom panel between said side panels of said U-shaped box blank at said box forming station, e. folding the trailing end flaps associated with one side panel inwardly against the stacked arrays of articles at said box forming station, f. moving the box blank and stacked arrays of articles horizontally out of said box forming station and the transfer shroud at right angles to said horizontal transferring step above, g. successively forming boxes in a like manner and moving them horizontally into a compression section where each succeeding box engages a preceding one to hold the side panels in place.

2. The method of claim 1 wherein said other two end flaps are folded as the box blank and array are moved in accordance with step f above.

3. The method of claim 1 wherein said box blank also has a top panel connected to one of said panels, and folding the top panel over the articles during step f above.

4. The method of claim 3 wherein said box blank further includes a manufacturer's tab connected to the free edge of said top panel, and folding this tab downwardly prior to the succeeding box engaging such tab in step g above.

* * * * *